US006308979B1

(12) United States Patent
Ludlow

(10) Patent No.: US 6,308,979 B1
(45) Date of Patent: Oct. 30, 2001

(54) RELEASABLE CROSS COUNTRY SKI BINDING

(76) Inventor: James A. Ludlow, 1925 E. 1700 S., Salt Lake City, UT (US) 84108

( * ) Notice: Subject to any disclaimer, the term of this patent is extended or adjusted under 35 U.S.C. 154(b) by 0 days.

(21) Appl. No.: 09/238,756

(22) Filed: Jan. 28, 1999

Related U.S. Application Data

(60) Provisional application No. 60/073,044, filed on Jan. 29, 1998.

(51) Int. Cl.[7] ..... A63C 9/18
(52) U.S. Cl. ..... 280/615; 280/620
(58) Field of Search ..... 280/613, 617, 280/618, 619, 620, 614, 615

(56) References Cited

U.S. PATENT DOCUMENTS 2,172,669 * 9/1939 Taft ..... 280/614
2,764,418 * 9/1956 Shimizu ..... 280/614
4,134,603 1/1979 Zoor .
4,152,009 5/1979 Schmid .
4,348,036 9/1982 Settembre .
4,531,309 * 7/1985 Vandenberg et al. ..... 280/615 X
4,639,010 1/1987 Scheck et al. .
4,768,805 9/1988 Graillat .
4,915,406 * 4/1990 Graillat ..... 280/615
5,823,563 * 10/1998 Dubuque ..... 280/615
5,897,127 * 4/1999 Hauglin ..... 280/615
5,924,719 * 7/1999 Girard ..... 280/615
6,017,050 * 1/2000 Girard ..... 280/615
6,062,586 * 5/2000 Korman ..... 280/613

* cited by examiner

*Primary Examiner*—Michael Mar
(74) *Attorney, Agent, or Firm*—Brian C. Trask

(57) ABSTRACT

A step-in, releasable cross country binding mechanism allowing rotational and/or forward release of the binding toe piece and skier from the ski. A cleat, mounted to the bottom of a binding toe pieces is relesably retained by spring loaded structure located between a ski boot and ski. A step-in heel piece is connected to the toe piece by a cable.

21 Claims, 6 Drawing Sheets

RELEASABLE CROSS COUNTRY SKI BINDING

PRIORITY CLAIM

This application claims the priority of U.S. provisional patent application Ser. No. 60/073,044, filed Jan. 29, 1998 for "RELEASABLE CROSS COUNTRY BINDING."

BACKGROUND OF THE INVENTION

1. Field of the Invention

This invention pertains to ski bindings, and particularly to such bindings especially adapted for use in cross country skiing.

2. State of the Art

Ski bindings suitable for alpine skiing are not generally suitable for cross country skiing. Neither are cross country ski binding generally useful for Alpine skiing. Release mechanisms are well developed for alpine bindings, but not for cross country bindings. Many efforts have been made to design bindings adaptable to both types of skiing, but those efforts have been generally unsatisfactory. Zoor, in U.S. Pat. No. 4,134,603 discloses a releasable ski binding which can be adapted to use as a cross-country binding. However, bindings of this type, having a plate or rigid member disposed under the ski boot, require a hinged mechanism to pivot about, or in front of, the toe. Such a pivot location forces an unnatural tip-toe walking motion which makes walking any distance unduly tiring. In U.S. Pat. No. 4,348,036, Settembre discloses a spring loaded scissor-action mechanism using an opposed ball-in-socket mechanism to secure a toe piece to a ski. This device has pivoting linkage members of considerable length which may allow unacceptable motion of the binding relative the ski, particularly when used by an aggressive skier. Alternatively, more stout members may be prohibitively heavy. The releasable binding disclosed by Scheck et al in U.S. Pat. No. 4,639,010 appears to require a rotation about a point undesirably forward of the skier's toe. U.S. Pat. No. 4,768,805 (Graillat) discloses a releasable binding which requires a specially built shoe. An improved releasable cross-country binding suitable for use with boots having an extended (typically 75 mm) toe portion is desired to provide a safer, yet rigorous, binding for this common boot configuration.

SUMMARY OF THE INVENTION

The invention provides a releasable cross country ski binding comprising: a cleat mounted to the underside of a ski binding toe piece, a cleat mounting plate for locating the cleat, and a release mechanism. The binding may be adapted to commercially available cross-country binding toe pieces. It is also within contemplation for a cleat to be incorporated into the sole of a ski boot. Flexing of a cross-country ski boot remains about the ball of a foot, allowing comfortable travel compared to plate bindings with a hinge point in front of (or below) the boot toe area. In a preferred embodiment, the release mechanism is a pivotal swing arm and is mounted at the rear of the cleat mounting plate. In the currently preferred embodiment, a spring loaded piston is located to the rear of the swing arm and provides variable loading pressure against the swing arm. Other spring and swing arm locations are operable. Pressure exerted on the swing arm by the piston is adjusted by rotating a screw carrying indicia and controlling spring compression. The binding may also have a heel piece connected to the toe piece by a cable. Cable length may be varied to accommodate ski boots of various dimensions by a cable adjustment mechanism incorporating a threaded bar and located within the heel piece, or by screw adjustment of retaining nuts at the toe piece attachment structure. Step-in assembly of the binding to a ski boot is provided by a cam shaped lobe, or cam-like rocker, component of the heel piece.

The components of a ski binding release mechanism of this invention are housed in a body capable of being attached to a ski and having recesses holding: a backing plate which structurally secures the cleat mounting plate, a cleat mounting plate, a swing arm, and a spring loaded piston. The body also houses the aforementioned spring pressure adjustment screw. Indicia carried by the screw, or revealed by screw travel, provides visual feedback for relative binding release force.

An exemplary release mechanism comprises a hook structure having a notch to interface with structure associated with a cleat. The preferred embodiment has a swing arm carrying the hook and notch. An alternate embodiment within contemplation uses a sliding mechanism to carry the hook and notch. In any event, retention force is provided by a spring element. An exemplary cleat mounting plate has directional assisting tabs which guide a cleat vertically out of a recess in the mechanism body during a release. Structure of the cleat mounting plate forms a retaining socket which locates pivot structure of a cleat. An exemplary cleat attaches to a ski binding toe piece and provides pivot structure to interface with the cleat mounting plate, and indexing structure to interface with the hook and notch of the release mechanism.

A heel lift plate, having a thickness similar to that of the body, provides a level support for a ski boot that is offset from the surface of the ski. Separation of the body and heel lift plate by a distance in the length direction of the ski allows a more uniform flexing of the ski in a turn, thereby preventing the stiffening effect associated with a solid plate binding. The thickness of the body and plate may be varied to increase elevation of the ski boot sole and binding toe piece above the surface of the snow. Workable elevations are thought to be between about 10 mm and approximately the width of the ski. The elevation of the ski boot sole by the body and plate thicknesses provides significant advantages to a skier. For example, the elevated toe piece allows a more aggressive turn, with increased angulation, without danger of grazing the snow by the edge of the toe piece. Moreover, the elevation provides a leverage to better hold an edge in a turn. A ski brake may be incorporated into either the body or plate. A temporary heel support, or "televator" may alternatively be incorporated into the heel lift plate.

BRIEF DESCRIPTION OF THE DRAWINGS

In the drawings, which illustrate what is currently regarded as the best mode for carrying out the invention.

DETAILED DESCRIPTION OF THE ILLUSTRATED EMBODIMENT

Figure 1:
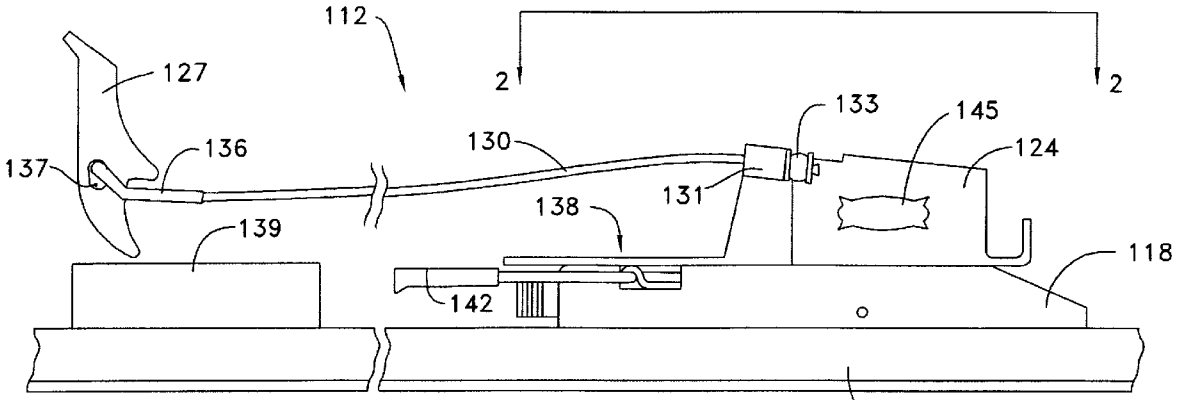
FIG. 1 is a view in side elevation, illustrating a currently preferred practical embodiment of a releasable binding assembly.
Figure 3:
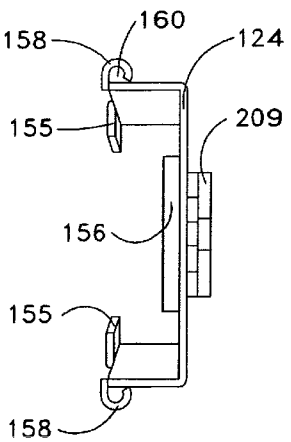
FIG. 3 is an end view of the binding toe piece of FIG. 2, as indicated by section line 3—3 and looking in the direction of the arrows.
Figure 2:
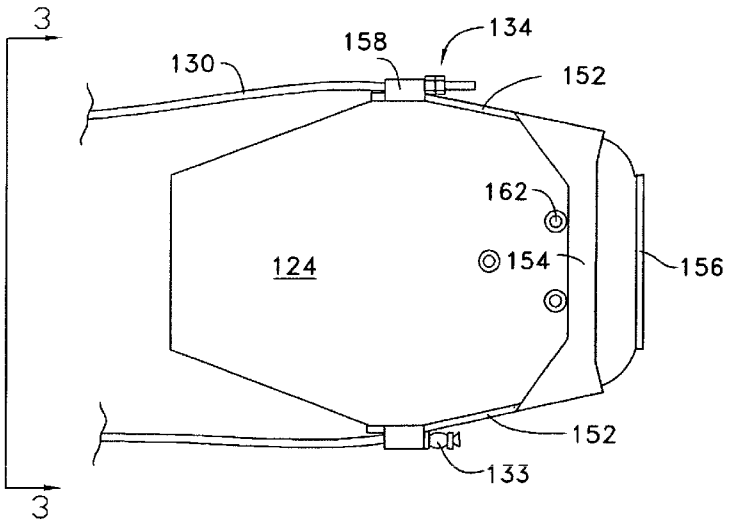
FIG. 2 is a top view of the binding toe piece of FIG. 1, as indicated by section line 2—2 and looking in the direction of the arrows.
Figure 19:
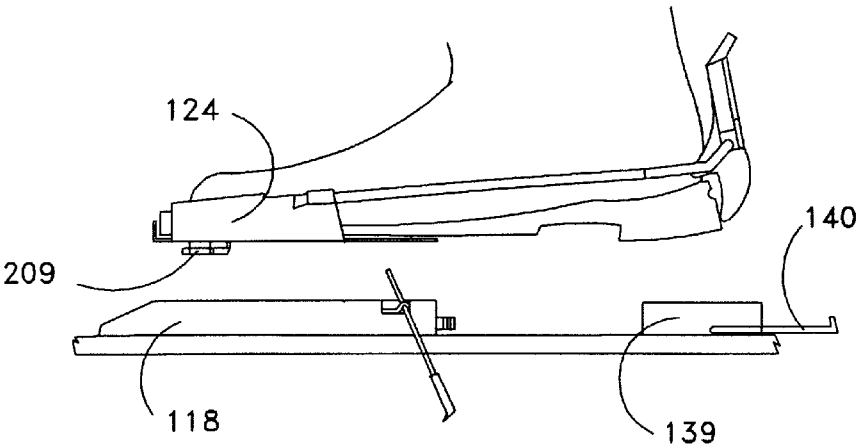
FIG. 19 illustrates a ski binding toe piece carrying a cleat and associated with a boot prior to connection with a release mechanism body.
Figure 20:
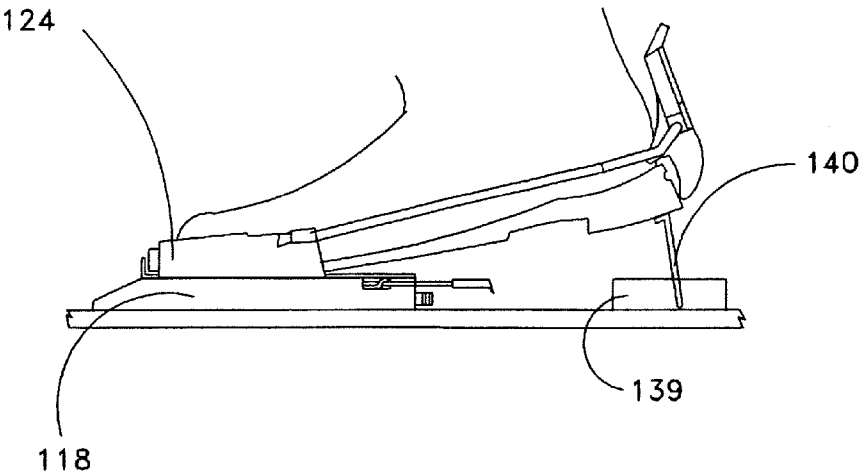
FIG. 20 illustrates the binding of FIG. 19 in a fully assembled condition.
Figure 21:
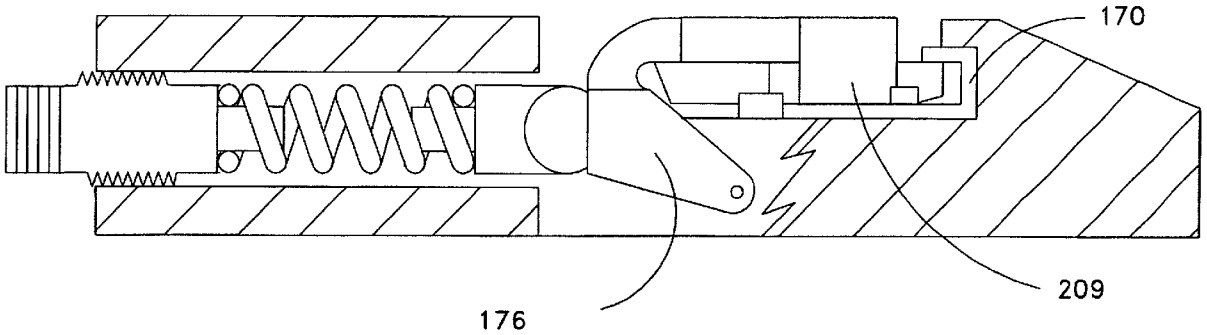
FIG. 21 is a side view in elevation, partially in section, of a cleat mounted in assembled position relative to a cleat mounting plate and a swing arm.
Figure 22:
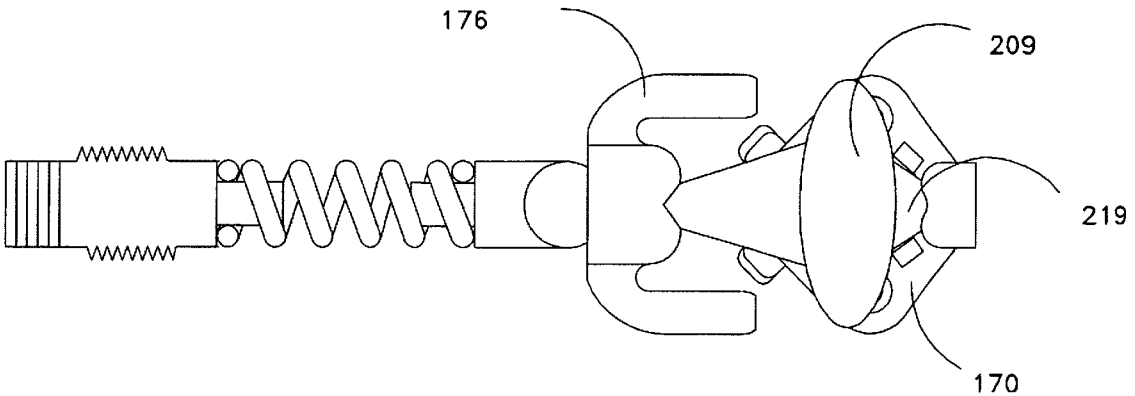
FIG. 22 shows a view of the cleat and mounting structure of FIG. 21, looking in the direction of the arrows 22—22.
Figure 23:
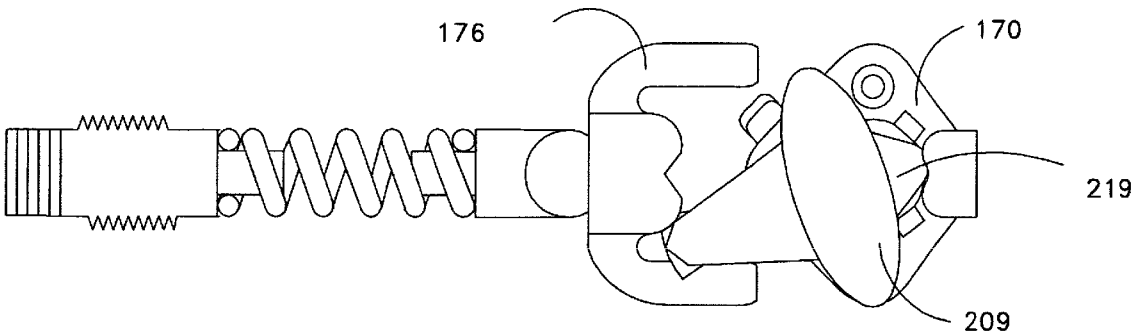
FIG. 23 illustrates the structure of FIG. 22, but with the cleat rotated toward a release position.

The currently preferred embodiment of the invention is shown in FIGS. 1–18. FIG. 1 presents the entire releasable binding assembly 112 in a side elevation view and attached to a ski 115. The binding assembly comprises a release mechanism body 118, a toe piece 124, and a heel piece 127. As shown by FIGS. 1 and 2, heel piece 127 is secured to toe piece 124 by cable 130. Forward ends of cable 130 pass through cable retaining structure 131 and are secured against retraction by cable retention structure, including but not limited to: a swedged ball 133, or a threaded locknut and shaft assembly 134. A threaded locknut and shaft assembly 134 is one advantageous way to provide adjustment in cable length to fit the binding to different ski boot sizes. At the rear of the binding, cable 130 passes through cable tube 136, which resides in slot 137 through heel piece 127. A ski boot heel is supported at a height comparable to surface 138 of toe piece 124 by heel lift plate 139. Separation of body 118 and heel lift plate 139 allows a more uniform flexing of ski 115, without causing a 'flat spot' associated with a rigid one-piece member. A temporary heel elevator device 140 (see FIGS. 19 and 20), to provide heel support while hiking up hill, may be incorporated into lift plate 139. A ski brake mechanism 142 may be accommodated in release mechanism body 118 as shown in FIG. 1. Ornamental designs or cutouts, 145 may be advantageously provided to decorate or reduce weight of toe piece 124.

Toe piece 124 (FIGS. 1–3) is provided to secure a ski boot to the binding. The embodiment of the toe piece 124 comprises a horizontal plate; forming surface 138, and having three vertically bent walls designed to retain all makes of 75 mm cross country and telemark boots having a forward extending sole. Two lateral retaining walls 152 provide lateral boot retention and prevent rotation of the boot relative to the binding. Each lateral retaining wall 152 has an additional bend, thereby forming unitary retaining bar 154 (FIG. 2) which overlaps the extended sole of a ski boot. An alternate embodiment, shown in FIG. 3, has two separated retaining bars 155 which similarly restrain the ski boot toe from vertical displacement relative the toe plate surface 138. In the illustrated embodiments, boot sole thicknesses of various thicknesses are accommodated between retaining bars 154 or 155 and surface 138 through deflection of the boot's forefoot rocker. Of course, a vertically adjustable boot-sole toe clamping mechanism may alternately be incorporated in the toe piece 124. It is envisioned that this type of releasable binding may also be adapted to commercially available cross-country bindings, including those having three pins and a clamping bail, or other boot retaining methods, thereby eliminating the need for a heel piece and cable. An alternative embodiment within contemplation incorporates a cleat into the sole of a ski boot. As illustrated, vertically bent forward toe retaining wall 156 is located at the front most edge of the toe piece 124 and is structured and arranged to provide a small offset from an inserted (new) ski boot, allowing for forward boot adjustment to accommodate wear of the boot sole. The two lateral retaining walls each have cylindrical bends 158 forming cable tubes 160 for placement of the cable 130 that attaches the heel piece 127. The embodiment of FIG. 2 has three countersunk holes 162, in the flat portion of the toe piece 124, for placement of mounting screws (not shown) to secure toe piece 124 to structure interfacing with release mechanism body 118.

Figure 4:
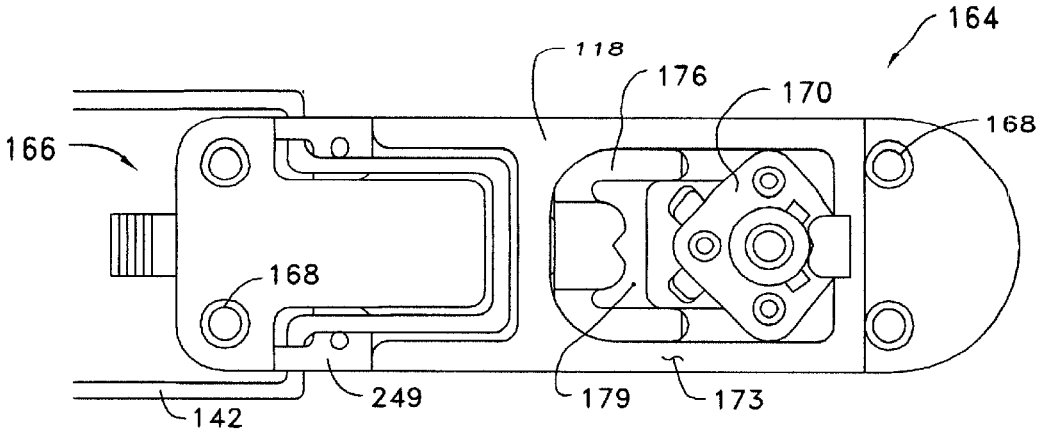
FIG. 4 is a top view of the release mechanism body of FIG. 1 in an assembled configuration.
Figure 6:
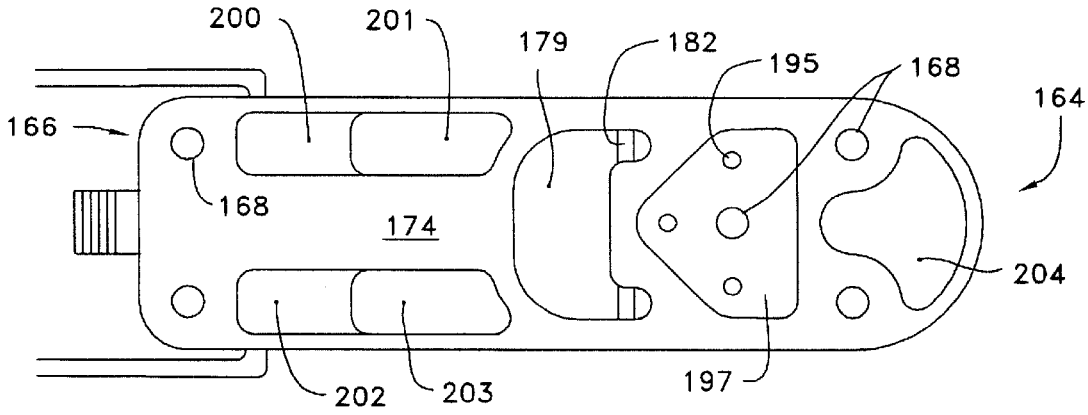
FIG. 6 is a bottom view of the release mechanism body as illustrated in the assembly of FIG. 1, but with certain elements removed.
Figure 7:
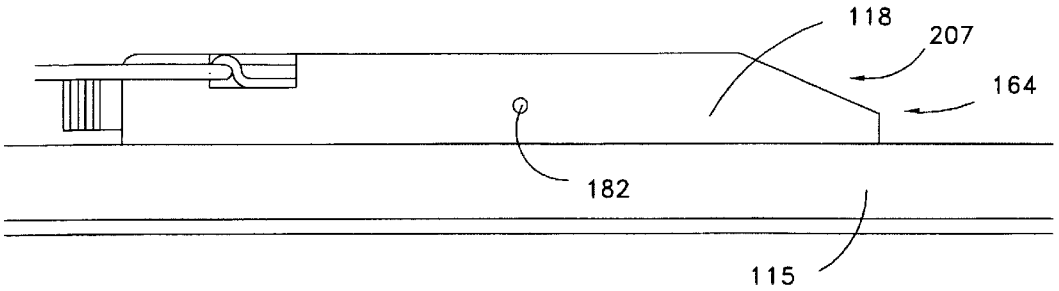
FIG. 7 is a side view of the release mechanism body of FIG. 1.
Figure 10:
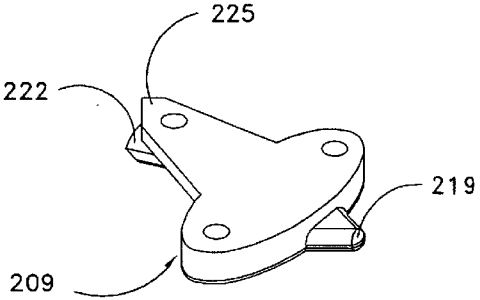
FIG. 10 is a top view in perspective of the embodiment of FIG. 8.
Figure 11:
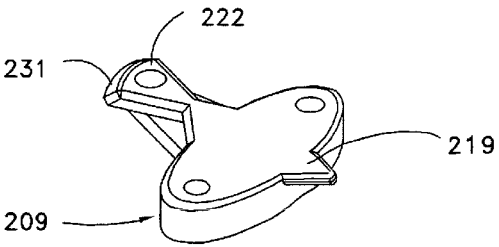
FIG. 11 is a bottom view in perspective of the embodiment of FIG. 8.
Figure 9:
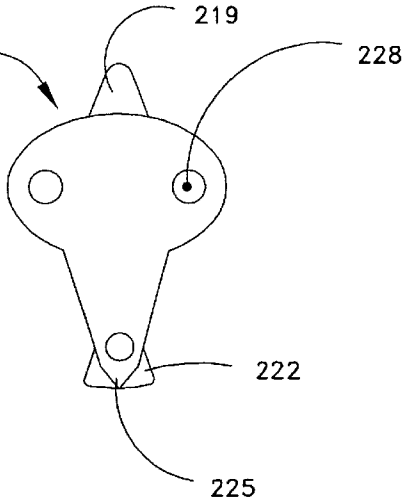
FIG. 9 is a top view of the embodiment of FIG. 8.

The release mechanism body 118, shown in FIGS. 4, 6 and 7, has a generally rectangular shape, with the front end 164 having a rounded shape and the rear end 166 being more boxed. The preferred embodiment of release mechanism body 118 is fabricated out of metal, plastic or similar rigid material, with high tech plastics, such as, Acetyl, currently being the material of choice. The body 118 is attached to the ski by means of five mounting screws (not shown) through holes 168, four of which are located approximately symmetrically in each corner and the fifth is placed on a center axis, but offset closer to the front two mounting screws in the center of the cleat mounting plate 170. Other mounting configurations and attaching methods are operable.

The top surface 173 (FIG. 4) and bottom surface 174 (FIG. 6) of release mechanism body 118 have several recessed areas and holes configured and arranged to receive individual structural elements comprising the release mechanism. Ski brake 142 may be incorporated into the binding assembly; either in release mechanism body 118, or alternatively in heel lift plate 139. A swing arm 176 is positioned in a through hole 179 in body 118. Swing arm 116 is rotatably.mounted to body 118 by swing arm axle 182

Figure 5:
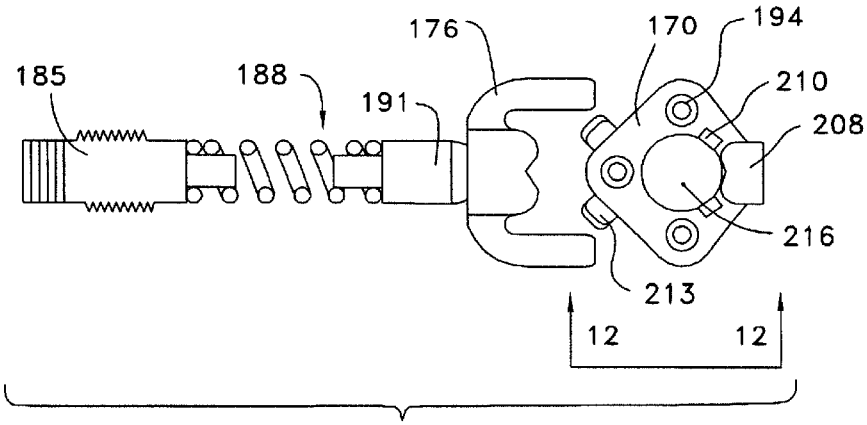
FIG. 5 shows the assembly arrangement, partially in section, of elements comprising a release mechanism.

(FIG. 6). A threaded cylindrical through-bore (not shown) between rear end 166 and hole 179 receives a threaded spring retention screw 185, spring 188, and piston 191 (FIG. 5). Cleat mounting plate 170 has three countersunk holes 194 to receive mounting fasteners (not shown) which correspond to threaded holes 195 in cleat backing plate 197. Recesses 200, 201, 202, 203, and 204 are provided in bottom surface 174 for weight reduction. FIG. 7 shows swing arm axle 182 located in a transverse bore in release mechanism body 118. Axle 182 may be a press fit shaft, such as a dowel pin, a threaded shoulder bolt, or any other suitable structure to rotatably secure swing arm 176 to body 118. In the presently preferred embodiment, front end 164 has a tapered area or sloped cut 207 to allow clearance of the toe piece 124 while assembling the binding 112 after a release.

Figure 8:
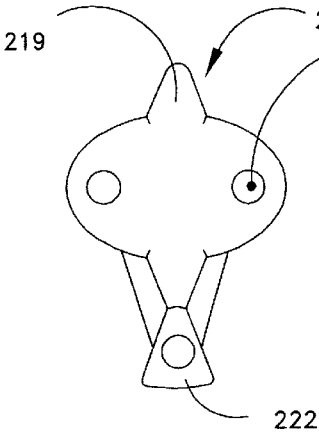
FIG. 8 is a bottom view of an embodiment of a cleat element of a release mechanism.

The cleat mounting plate 170 (FIGS. 5 and 12) has a hooked front shape 208 to overlap and retain the front tab 219 of the cleat 209 (FIG. 8). Two locating tabs 210 are placed symmetrically offset near the front of the cleat mounting plate 197 and are at approximately a 90 degree angle with reference to the cleat mounting plate 197. Two directional tabs 213 are located symmetrically offset near the rear of the cleat mounting plate 170. The illustrated embodiment of the cleat mounting plate 170 comprises a flat diamond shape having a large center hole 216 and the aforementioned hook 208 and tabs 210 and 213. The cleat backing plate 197 is flat with dimensions similar to the cleat mounting plate 170.

The cleat 209 (see FIGS. 8–11) comprises a cross-type shape having a front tab 219 that fits in a socket 220 (FIG. 12) formed between the locating tabs 210 and under the hook 208 of the cleat mounting plate 170. Front tab 219 comprises pivot structure about which cleat 209 may pivot in coordination with socket 220. Additionally, a rear cleat tab 222 is provided with an upper locating rib 225 that both retains and locates the cleat 209 with reference to the swing arm 176. The illustrated cleat 209 has three threaded mounting holes 228 to connect the cleat 209 to a toe piece 124. Alternative mounting methods, including but not limited to, incorporating a keyway or other structural interference to prevent relative motion between the cleat 209 and toe piece 124, are within contemplation. Beveled surface 231 (FIG. 11) of rear cleat tab 222 slidingly interfaces with swing arm 176 during assembly of the cleat 209 into engagement with cleat mounting plate 170 and swing arm 176. Beveled interfacing surfaces accommodate for wear of the individual components, and prevent rattle of the assembled safety binding.

The pivotal swing arm 176 (FIG 13) has two forward reaching arms 234, each with a perpendicularly bored hole 237 to receive axle 182 (FIG. 6). A hook 240 is located in the rear and center of the swing arm 176 and has a notch 243 to aid in locating and retaining the upper locating rib 225 of cleat 209. A spherical divot 246 (FIG. 14) is placed in the rear most surface of the swing arm for mating of the piston head 191. Once mated with the piston head 191 (FIG. 5), a force greater than that generated by the compressed die spring 188 must be applied to release the cleat 209 from between the swing arm 176 and the cleat mounting plate 170.

Figure 15:
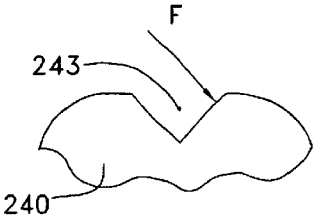
FIG. 15 is a sectional top view of the embodiment illustrated in FIG. 13, as indicated by section lines 15—15, and looking in the direction of the arrows.
Figure 14:
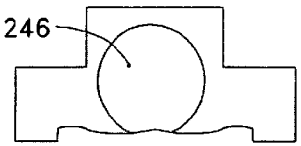
FIG. 14 is a rear view of the embodiment illustrated in FIG. 13, as indicated by section lines 14—14, and looking in the direction of the arrows.
Figure 13:
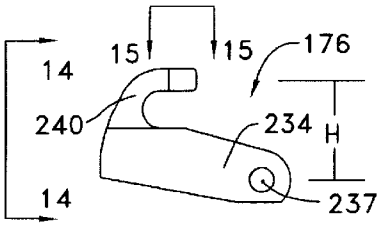
FIG. 13 is a view in elevation of a swing arm according to the currently preferred embodiment.
Figure 12:
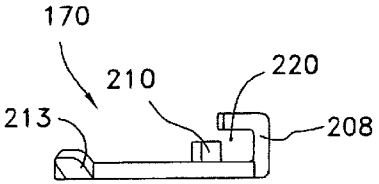
FIG. 12 is a side view of the cleat mounting plate illustrated in FIG. 5, as indicated by section line 12—12, and looking in the direction of the arrows.

The cleat 209 is designed to release from confinement between the swing arm 176 and socket 220 of cleat mounting plate 170 in either of two release modes. A first release mode is a torsional, or twisting release see FIGS. 15, 21–23. In this first mode, cleat tab 219 pivots about socket 220 as toe piece 124 rotates in a plane approximately parallel to surface 173. Directional tabs 213 help guide cleat 209 vertically to escape the mounting recess in body 174. A second release mode results from a direct heel lift, such as might accompany a fall comprising a face plant. This second mode may be visualized by reversing the assembly procedure illustrated in FIGS. 19 and 20. Of course, the binding is also capable of releasing in a combination of these two modes. As shown in FIG. 15, which illustrates a torsional release, a force F is asserted on swing arm 176 by cleat rib 225. The structural configurations of swing arm notch 243 and cleat rib 225 cooperatively create a resultant force on swing arm 176. This resultant force is located a distance H from axle 182, causing swing arm 176 to rotate about axle 182, moving hook 240 back and down, thereby releasing cleat 209. A release by direct heel lift comprises similar mechanics, wherein forces to compress the die spring 188 and retract hook 240, thereby releasing the cleat 209, are generated by structure comprising cooperative beveled surfaces.

The retention force of the illustrated embodiment is generated by a three part system containing a piston head 191, die spring 188 and a threaded indicator screw 185. As the indicator screw 185 is threaded into the body 118, it pushes the die spring 188 into the piston head 191 which in turn pushes on the swing arm 176. The piston head 191 and outer diameter of the die spring 188 are approximately equivalent as are the radii of mating divot 246 and the face of the piston head 191. Both the piston head 191 and the indicator screw 185 have axially symmetric protrusions that are of slightly smaller diameter than and assemble into the inner diameter of the die spring 188. Colored bands and/or numbers may be placed on the exterior surface of the indicator screw 185 to provide a "relative" indication of the retention force. An alternative embodiment within contemplation (not shown) replaces forward reaching arms 234 and axle 182 with a rearward sliding mechanism to form release mechanism replacing the swing arm 176. In such an embodiment, release forces would primarily cause a translation of the alternate release mechanism, thereby releasing cleat 209. The illustrated embodiment depicts a spring loaded release, mechanism located in a rear portion of body 118. Of course the mechanism may be oriented in other configurations, including at the forward end of body 118. Such a forward mounting configuration may provide benefits such as tension adjustment without requiring removal of the ski boot from the binding.

A braking mechanism 142 may be provided to stop the ski in the event of a binding release. Two brake mounting cleats 249 (FIG. 4) are provided to hold and position the brake in both the closed and open states. The brake cleat 249 is shaped to energetically favor the open position when the toe piece 124 is removed and to retract the two brake arms while the toe piece 124 is mated with the release mechanism body 118.

Figure 18:
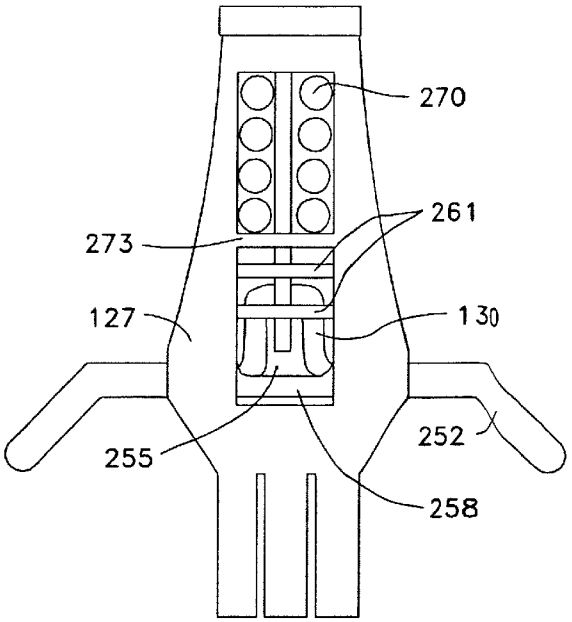
FIG. 18 is a rear view in elevation of the embodiment illustrated in FIG. 16, as indicated by section lines 18—18, and looking in the direction of the arrows.
Figure 17:
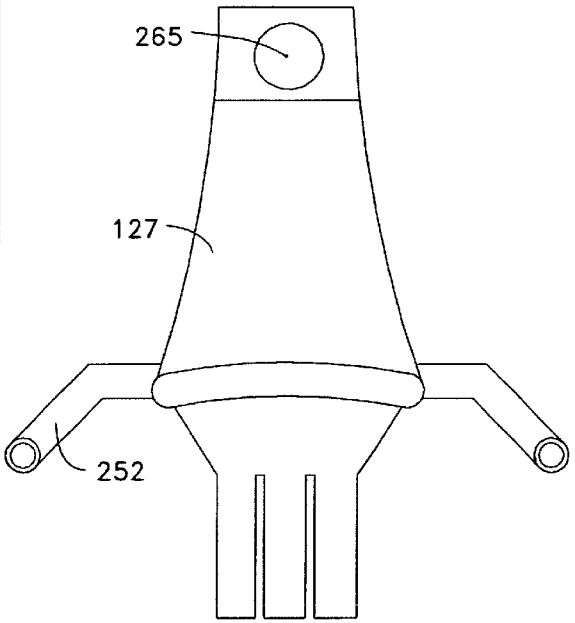
FIG. 17 is a front view in elevation of the embodiment illustrated in FIG. 16, as indicated by section lines 17—17, and looking in the direction of the arrows.
Figure 16:
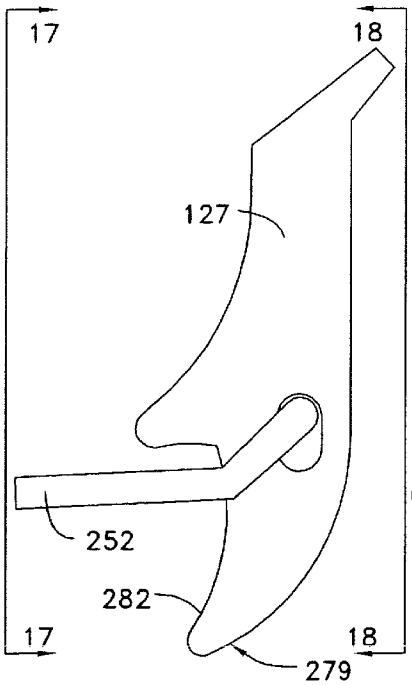
FIG. 16 is a side view in elevation of a heel piece of the currently preferred embodiment.

A heel piece 127 is provided to retain the boot in the toe piece. The heel piece 127 is connected to the toe piece 124 by means of cable 130. Referring now to FIGS. 16–18, the cable 130 is guided into the heel piece 127 by means of an approximately u-shape tube 252. Tube 252 has a transverse opening 255 in rear most section 258. This opening allows the cable 130 to be attached to hooking device 261 having an approximately "c" shaped cross-section and that can be raised or lowered to accommodate different boot sizes by turning the adjustment screw 264. Edges of hooking device 261 and transverse hole 255 are arranged to minimize kinking of cable 130 as the cable 130 bends to accommodate transverse deflection from tube 252. Adjustment screw 264 may be accessed through opening 265. The heel piece 127 has recess 267 for placement of a die spring 270. The adjustment screw 264 passes through the inner diameter of the spring 270 and through retaining wall 273, into recess 276, there to be threaded into the hooking device 261. A cam shaped rocker 279 is provided in heel piece 127 (FIG. 16) to facilitate assembly of the heel piece on a ski boot by stepping on corner 282.

The heel piece embodiment 127 may be fabricated out of a material similar to the release mechanism body 118. Elements comprising the release mechanism may be made from any suitable structural material. It is currently preferred to form items such as the toe piece 124, swing arm 176, cleat mounting plate 170, backing plate 197, and cleat 209 by a stamping or machining process from a stainless type of steel.

The invention has been described with particular reference to the illustrated embodiment. However, the scope of the invention is not intended to be limited by the illustrations, and is properly represented by the appended claims.

What is claimed is:

1. A cross country ski binding permitting a skier to elevate a ski boot heel relative to a ski while skiing, the binding being configured and arranged to provide a safety release of the ski boot from the ski, comprising:

a release mechanism body, structured for attachment to said ski, carrying:

a cleat mounting plate adapted to receive structure associated with a forward portion of a cleat;

a swing arm disposed rearward from said cleat mounting plate and rotatably mounted to said body, said swing arm being adapted to interface with a rear portion of said cleat whereby releasably to retain said cleat in captured engagement between said mounting plate and said swing arm; and a compression spring oriented and arranged to provide a variable force to resist rotation of said swing arm; and said cleat adapted for mounting to the bottom of a ski binding toe piece for association with said ski boot; wherein said ski boot may be coupled to said ski by placing said ski boot into association with said toe piece mounted to said cleat, said cleat being held in captured engagement between said cleat mounting plate and said swing arm thereby holding said cleat in an assembled position with respect to said body, said body being attached to said ski; and subsequent to said safety release, wherein said cleat is forced from said captured engagement by application of a force on said cleat sufficient to rotate said swing arm, an assembly comprising said ski boot and said toe piece and said cleat is uncoupled from said ski.

2. A ski binding according to claim 1, further comprising:

a heel piece adapted operatively to interface with said ski boot heel whereby to help maintain an association between said ski boot and said toe piece, said heel piece being spaced rearwardly from said toe piece by a cable, said cable being attached to structure associated with said toe piece.

3. A ski binding according to claim 2, said body comprising:

a first recess housing a backing plate structured and arranged to hold said cleat mounting plate in fixed position with respect to said body; and a second recess housing said cleat mounting plate;

said binding further comprising a heel lift plate adapted for attachment to said ski and being spaced rearwardly from said body and functional to elevate said ski boot heel relative to said ski when said ski boot is coupled to said ski by said binding.

4. A ski binding according to claim 3, wherein said cleat mounting plate comprises directional assisting tabs operative to guide said cleat out of said second recess in said body during a safety release.

5. A ski binding according to claim 2, wherein said heel piece has a cam shaped lobe to enable step-in engagement of said heel piece with said ski boot heel.

6. A ski binding according to claim 5, wherein said heel piece further comprises a cable adjustment mechanism whereby to accommodate ski boots of various sizes.

7. A ski binding according to claim 1, wherein said variable force to resist rotation of said swing arm is indicated by markings associated with a spring adjustment screw.

8. A safety releasable cross country ski binding permitting a heel of a ski boot to be elevated relative to a ski while in the process of skiing, the binding comprising:

a release mechanism body adapted for connection to said ski and carrying:

a cleat mounting plate arranged to receive a pivot structure of a cleat; and a safety release mechanism structured and arranged to resist movement of said cleat from an assembled position wherein said cleat is captured in releasable engagement between structure associated with said release mechanism and said cleat mounting plate, said release mechanism comprising a compression spring mechanism structured and arranged to provide a variable required force to effect a release; and said cleat being adapted to depend from the bottom of a ski binding toe piece which is constructed for association with said ski boot; wherein said ski boot may be coupled to said ski by placing said ski boot into association with said toe piece from which depends said cleat, said cleat being in captured engagement between said cleat mounting plate and said release mechanism thereby holding said cleat in an assembled position with respect to said body, said body being attached to said ski; and subsequent to a safety release, wherein said cleat is forced from said captured engagement by application of a force on said cleat sufficient to move said release mechanism, an assembly comprising said ski boot and said toe piece and said cleat is uncoupled from said ski.

9. A ski binding according to claim 8, further comprising a heel piece adapted to engage a heel portion of said ski boot and spaced apart rearwardly from said toe piece by a cable retained by structure associated with said toe piece, said heel piece and cable being cooperatively functional to maintain an association between said ski boot and said toe piece.

10. A ski binding according to claim 8, said release mechanism body having a thickness dimension spacing a surface offset from said ski.

11. A ski binding according to claim 10, further comprising a heel lift plate adapted for connection on a ski rearward from said body to interface under a heel of said ski boot and having a thickness dimension similar to said body's thickness dimension.

12. A ski binding according to claim 11, further comprising a heel piece operative to engage a heel portion of said ski boot and spaced apart rearwardly from said toe piece by a cable retained by structure associated with said toe piece, said heel piece and cable being cooperatively functional to maintain an association between said ski boot and said toe piece.

13. A ski binding according to claim 12, wherein said heel piece further comprises a cable adjustment mechanism to accommodate ski boots having different sizes.

14. A ski binding according to claim 13, wherein said heel piece comprises structure having a camlike rocker to provide step-in capability wherein said heel piece is brought into engagement with said heel portion of said ski boot as a skier steps into said binding.

15. A ski binding according to claim 11, said release mechanism body having a plurality of recesses housing:

a backing plate, structured and arranged to hold said cleat mounting plate;

said cleat mounting plate; and said release mechanism.

16. A ski binding according to claim 8, wherein:

said body houses structure having directional assisting tabs to guide said cleat out of a recess in said body during a release; and said release mechanism comprises a hook structure having a notch adapted to interface with structure associated with said cleat.

17. A ski binding according to claim 16, wherein said release mechanism comprises a swing arm carrying said hook and notch.

18. A ski binding according to claim 16, wherein said release mechanism comprises a sliding mechanism carrying said hook and notch.

19. A releasable cross country ski binding permitting a heel of a ski boot to be elevated relative to a ski while in the process of skiing, comprising:

a cleat adapted to depend from structure controllable by the forefoot of a ski boot; and a release mechanism body, adapted for attachment to said ski, housing:

locating means for receiving structure associated with said cleat; and release means to releasably retain said cleat in an assembled position between structure associated with said release means and said locating means, thereby to releasably hold said cleat in coupled relation to said body for operation of said binding while skiing; and a compression spring mechanism structured and arranged to provide variable loading on said release means whereby to vary the force required to effect a safety release; wherein:

said ski boot may be coupled to said ski by placing said cleat in captured engagement between said locating means and said release means thereby holding said cleat in an assembled position with respect to said body, said body being attached to said ski; and subsequent to a release, wherein said cleat is forced from said captured engagement by application of a force on said cleat sufficient to actuate said release means and to decouple said cleat from said body, an assembly comprising said ski boot and said cleat is uncoupled from said ski.

20. A ski binding according to claim 19, further including:

a heel piece operative to engage a heel portion of said ski boot and spaced apart rearwardly from said forefoot by a cable retained by structure associated with a ski binding toe piece.

21. A cross country ski binding assembly configured and arranged to provide a safety release of a ski boot from a ski, comprising:

a toe piece configured for receiving a toe portion of a ski boot, said toe piece including a cleat mounted to a bottom surface of said toe piece and depending downwardly therefrom;

a release mechanism body structured for attachment to a ski;

a cleat mounting plate disposed within said body and configured for engagement with a forward portion of said cleat;

a U-shaped swing arm disposed rearwardly of said cleat mounting plate within said body and rotatably mounted relative to said body, said swing arm being adapted to interface with a rear portion of said cleat; and a compression spring disposed within said body, said spring being oriented and arranged to provide a variable force resisting rotation of said swing arm, wherein said toe piece is held in a captured and safety releasable relation relative to said release mechanism body when said cleat is received within said body in an assembled position between said cleat mounting plate and said swing arm; and a heel piece operatively connected to said toe piece and configured for engagement with a heel portion of said ski boot, said heel piece functioning to maintain said toe piece secured to said ski boot while permitting a heel portion of said ski boot to be raised to an elevated position relative to said ski.

* * * * *